US008966714B2

(12) United States Patent
Bertani

(10) Patent No.: US 8,966,714 B2
(45) Date of Patent: Mar. 3, 2015

(54) HINGE HAVING AN EMBEDDED SAFETY SWITCH

(71) Applicant: ELESA S.p.A., Milan (IT)

(72) Inventor: Alberto Bertani, Mozna (IT)

(73) Assignee: ELESA S.p.A., Milan (IT)

( * ) Notice: Subject to any disclaimer, the term of this patent is extended or adjusted under 35 U.S.C. 154(b) by 0 days.

(21) Appl. No.: 14/173,350

(22) Filed: Feb. 5, 2014

(65) Prior Publication Data

US 2014/0230191 A1 Aug. 21, 2014

(30) Foreign Application Priority Data

Feb. 18, 2013 (IT) ..... MI20130061 U

(51) Int. Cl.
*E05D 11/10* (2006.01)
*E05D 11/00* (2006.01)
*H01H 3/16* (2006.01)

(52) U.S. Cl.
CPC ..... *E05D 11/10* (2013.01); *E05D 11/00* (2013.01); *H01H 3/16* (2013.01)
USPC ..... 16/349

(58) Field of Classification Search
CPC ..... E05D 11/0054; E05D 11/1078; E05D 13/006; E05D 15/526; E05D 15/5263
USPC ..... 16/250, 262, 319, 324, 349, 351, 374, 16/387; 200/61.7, 61.62
See application file for complete search history.

(56) References Cited

U.S. PATENT DOCUMENTS

| | | | | |
|---|---|---|---|---|
| 3,742,162 | A * | 6/1973 | Wasemann | 200/61.62 |
| 4,066,857 | A * | 1/1978 | Suska | 200/61.7 |
| 6,642,462 | B2 * | 11/2003 | Ninomiya et al. | 200/61.7 |
| 6,906,698 | B2 * | 6/2005 | Tachikawa et al. | 345/156 |
| 7,352,357 | B2 * | 4/2008 | Tachikawa et al. | 345/156 |
| 7,507,922 | B2 * | 3/2009 | Bertani | 200/61.7 |
| 7,694,388 | B2 * | 4/2010 | Campbell et al. | 16/239 |
| 7,915,986 | B2 * | 3/2011 | Lu | 335/285 |

* cited by examiner

*Primary Examiner* — Roberta Delisle
(74) *Attorney, Agent, or Firm* — Pearne & Gordon LLP

(57) ABSTRACT

A safety hinge, apt to constrain a door moving with respect to a fixed frame, of the type consisting of two main wing-shaped constituent members displaying a mutual-engagement area consisting of loops interconnected by a small shaft, with a first one of the wings a switch body being associated, which has a lateral opening in correspondence of an appendix thereof, arranged on the extension of the mutual-engagement area, through the opening peg for the actuation of the switch projecting. Within the appendix a bush is arranged, constrained to the by a second one of the wings, the bush displaying along an annular external crown thereof a groove for the housing of the peg in the closing position of the moving door on the fixed frame, that is in the opening position of the switch.

9 Claims, 2 Drawing Sheets

HINGE HAVING AN EMBEDDED SAFETY SWITCH

The present invention relates to a hinge having an embedded safety switch, otherwise said hinge with embedded travel end.

Hinges of this type had existed on the market, and are employed in industrial machinery, in particular for connecting bonnets to the frame, when it is particularly dangerous to access inside the machinery when it isi in use. Likewise, this kind of device may be used for standard access doors, to signal the entry or the exit of people.

Hinges with embedded travel end have recently replaced classic inventions, such as for example rotation travel ends or tab travel ends, since they have proved easier to be installed and capable of guaranteeing constant performances in the long run.

For example, the Applicant had filed a hinge of the type consisting of two main wing-shaped constituent members, and having a mutual-engagement area on a common pivoting axis, which provides that with one of said wings a head of the pivoting axis is integral, having a cam profile, and that at the other end a switch body be associated from which a control peg protrudes, the outer end of which engages with said cam profile and the end of which inside the switch body acts on an actuation button of the actual switch.

However, during marketing the users owning machinery with non-conventional openings has raised the need to obtain—during mounting—initial actuation angles different from the standard 0°.

Moreover, the requirement has been perceived to protect the switch body actuation mechanics from water and dust in as sealed a manner as possible, so as to allow the use of switches of unprotected switches, easier to find and economically more convenient.

Finally, the need has been felt to make such product more compliant of currently valid safety laws.

The object of the present invention is therefore to manufacture a hinge provided with a switch which has means apt to guarantee the adjustment of the actuation angle according to the panel construction requirements, and at the same time means apt to guarantee greater resistance to dusts and water, and consequently a smaller risk of breakage or malfunctioning of the device.

Said object is obtained through a safety hinge, apt to a constrain a door moving with respect to a fixed frame, of the type consisting of two main main wing-shaped constituent members having a mutual-engagement area consisting of loops interconnected through a small shaft, with a first one of said wings a switch body being associated, internally shaped so as to provide a channel, arranged on the extension of the mutual-engagement area, and to house a microswitch, said microswitch having an appendix housed within said channel on the top of which peg means project for the actuation of the switch, characterised in that within said appendix a bush is arranged, constrained to the movement of a second one of said wings, said bush having, along an outer annular crown thereof, a groove for the housing of said peg means in the closing position of said moving door on the fixed frame, that is, in the position of said microswitch.

Further features and advantages of the structure according to the invention result from the following detailed description of the invention, made with reference to the attached drawings, wherein:

FIG. 6 is the front view, wherein a cam member is highlighted, of a bush to be mounted on the top surface of the mutual-engagement area of the two constituent members of the hinge, of which

Figure 1:
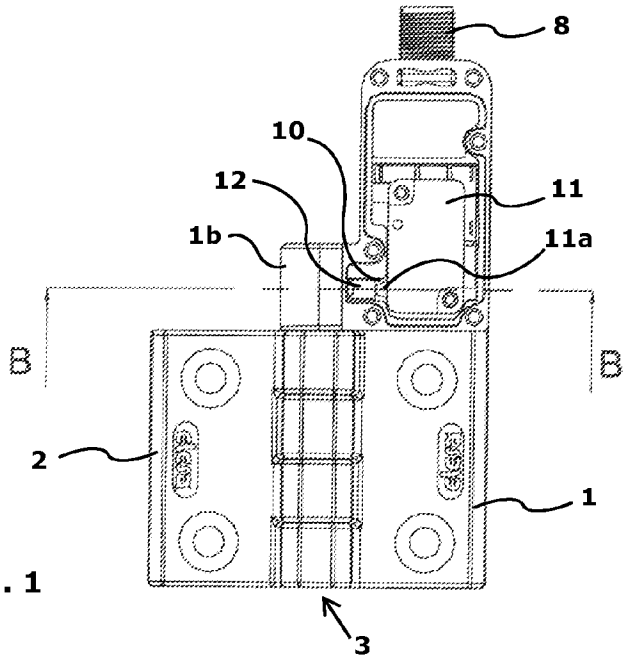
FIG. 1 is a front view of the hinge according to the invention, wherein the cover of the safety switch has been removed.
Figure 3:
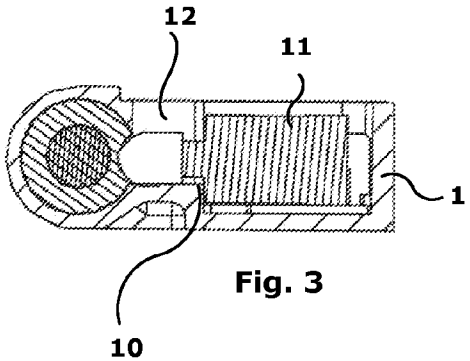
FIG. 3 is the view along the section B-B of FIG. 1.
Figure 2:
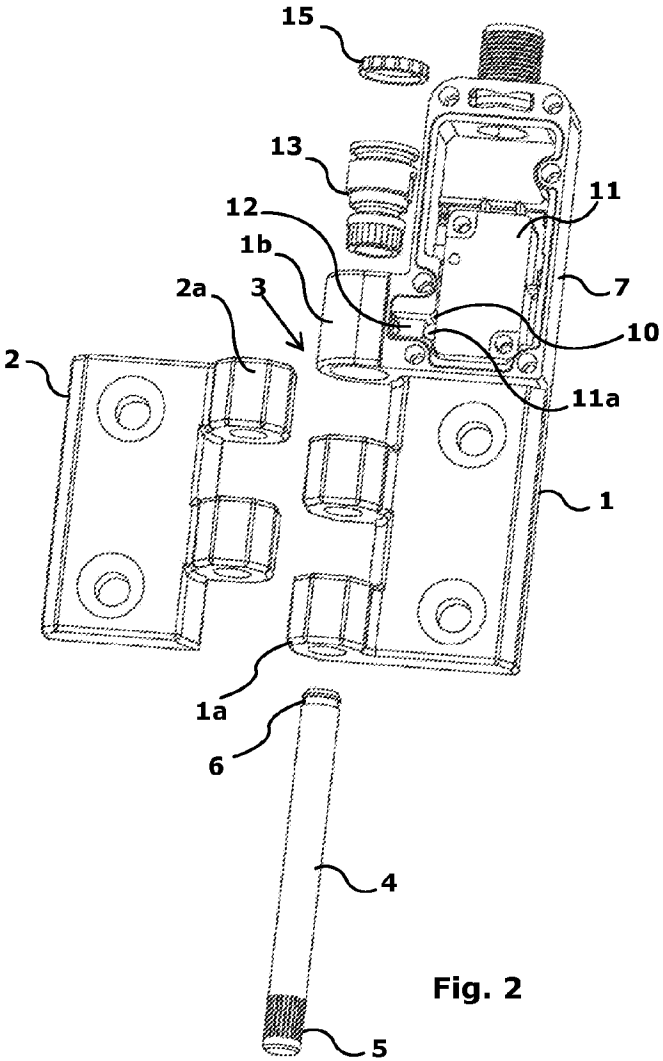
FIG. 2 is the exploded view of the hinge of FIG. 1.
Figure 5:
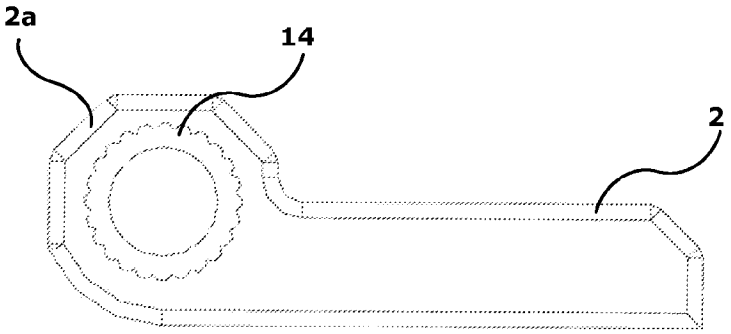
FIG. 5 is a top plan view of the constituent member of the hinge of FIG. 1 which does not carry the switch body.
Figure 7:
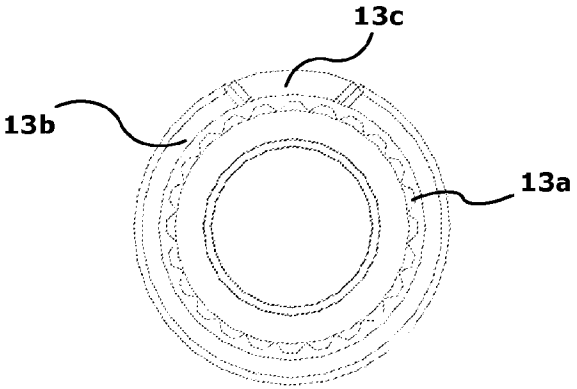
FIG. 7 is a bottom plan view.
Figure 4:
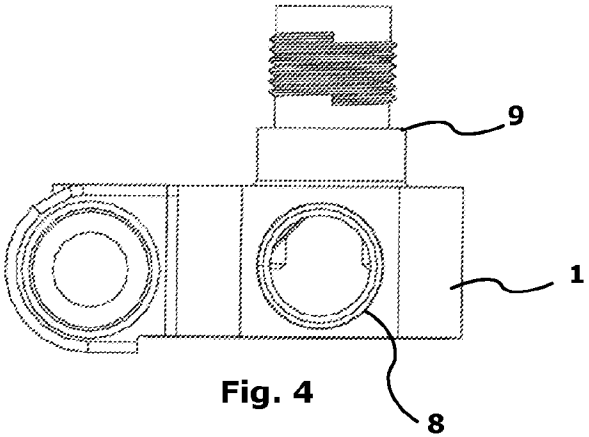
FIG. 4 is a top plan view of the constituent member of the hinge of FIG. 1 which carries the switch body.
Figure 6:
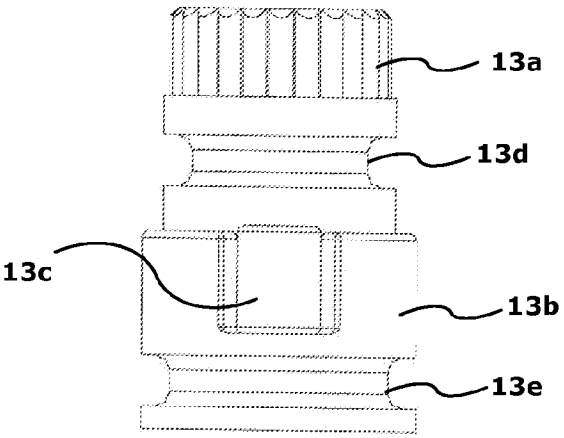

The hinge according to the invention consists of two main constituent members 1 and 2, identifiable as wings or hinge bodies—generally moulded of thermoplastic material, but which may be made also of other synthetic materials, or of rubber or of metal—shaped so as to have a mutual-engagement area 3, on a common pivoting axis.

Within the above-said mutual-engagement area 3 the insertion of a small shaft 4 is provided, suitably shaped so that it has at the ends thereof engagement members apt to guarantee the sealing of shaft 4 in a steady position. In particular, at one end a series of ribs 5 is provided parallel to the shaft axis and evenly distributed on the cylindrical surface thereof, apt to the interference engagement with the inner wall of lower loop is projecting from member 1. On the end of said small shaft 4 opposite to said ribs 5 an annular groove 6, for the function better described in the following, is instead provided.

On the top of wing 1 switch body 7 is fastened, integrally or ultra-sound welded, having the shape of a rectangle parallelepiped box with rounded corners, preferably obtained by moulding of thermoplastic material, at the top of which a preferably cylindrical guiding collar 8 is prepared. Moreover, on the rear wall a further guiding collar 9 is prepared. These two guiding collars 8, 9 are both prepared to allow the passage of conductive cables which connect to switch body 7.

From said body 1—in correspondence of said one switch body (7)—a top loop 1*b* departs, apt to the extension of the mutual-engagement area 3. Loop 1*b* is connected to said switch body 7 through a channel 10, which houses an appendix 11*a*, projecting from microswitch 11, on the end of which a peg 12 is provided free to slide in a horizontal direction. Such peg 12 acts as an actuation button of microswitch 11.

A bush 13 consisting of a body with a substantially cylindrical profile, but which has at one end a knurled portion 13*a*, and, at the other end, an annular crown 13*b* wherein a groove 13*c* is obtained. Above and below the area said groove 13*c* is provided there are provided toroidal notches 13*d* and 13*e* are provided, apt to house sealing O-rings.

Bush 13 is mounted from the top, in the cylindrical area 1*b* of wing 1, taking care to bringe the knurled portion 13*a* into keying-on engagement with the grooves 14 provided within the top loop 2*a* of constituent member 2. Moreover, groove 13*c* is precisely a the opening point of channel 10, so as to be able to house said peg 12 in the way described in the following.

Moreover, bush 13 is shaped so as to provide an upper sealing housing for shaft 4, internally having engagement means with the annular groove 6 of shaft 4, apt to guarantee the positioning, fixed only in an axial direction, of the shaft. Once the described complex has been thus assembled, it is ensured that shaft 4 remains integral with hinge member 1, due to keying on 5-1*a*, and that bush 13 is integral with hinge member 2, due to keying-on 13*a*-14. Thereby, when member 2 rotates with respect to member 1, annular crown 13*b*, with groove 13*c*, slides opposite peg 12 and appendix 11*a*.

At the end of the above-described mounting, a cover 15 is snap fastened, according to a very well-known technique and therefore not illustrated nor described, to close above the hollow of appendix 11*a*, so as to rule out the accidental coming off of bush 13.

The mounting operations require exclusively to fasten hinge member 1 to the frame and member 2 to the door, and subsequently to insert an electric energy connector into guiding collar 8, or into collar 9, to suitably connect it to microswitch 11 depending on the operator's requirements.

The constructor will be free to adjust bush 13 so that the groove 13*c* thereof is arranged with the desired angle with respect to the conventional closing position of the moving door, so as to guarantee the activation of the safety system at the necessary angle.

Once the mounting of the hinge according to construction requirements has finished, body 7 is closed by a cover provided with protection seal, fastened by screws. Thereby the guarantee of insulation from water and dust is obtained.

During operation, with the machine, peg 12 is housed in groove 13*c*, where it is kept in rest position by spring associated with appendix 11*a* and contained in the microswitch. When the door is opened, peg 12 is forced to come out of groove 13*c*, resting on the cam profile 13*b* of bush 13—which is led by the engagement with loop 2*a* to rotate integrally with the door—and consequently to withdraw towards the microswitch, along appendix 11*a*. Thereby, the safety circuit is actuated, for example switching off the machinery or issuing an alarm signal. Once the door has been brought back into a closed position, per 12 is housed back in groove 13*c*, consequently switching off the circuit.

As can be easily understood, the possibility of adjusting during adjustment the angle of the groove allows the hinge the actuation of the safety device at the required door opening angle.

From the above-reported description it is evident that the set objects have been reached, that is, a hinge provided with a switch which has means apt to guarantee the adjustment of the activation angle according to the panel construction requirements, and at the same time means apt to guarantee greater resistance to dust and water, and consequently fewer risks of breakage or malfunctioning of the device.

A special layout of the engagement area between the peg member of the switch and the bush of the pivoting member has been obtained so as to remarkably reduce the risk of undesired dust deposits.

However, it is understood that the protection of the above-described invention must not be considered limited to the special embodiment illustrated, but extends to any other technically equivalent construction variant, falling within the scope of the attached claims.

The invention claimed is:

1. Safety hinge, apt to constrain a door moving with respect to a fixed frame, of the type consisting of two main wing-shaped constituent members (1, 2) having a mutual-engagement area (3) consisting of loops (1*a*, 2*a*) interconnected by means of a small shaft (4), with a first one of said wings (1) a switch body (7) and a top loop (1*b*) apt to the extension of the mutual-engagement area (3) being associated and connected to said switch body (7) by a channel (10), said switch body (7) housing a microswitch (11) which has an appendix (11*a*) housed in said channel (10) on the top of which peg (12) for the actuation of the switch project, wherein within said top loop (1*b*) a bush (13) is arranged, constrained to the movement by a second one (2) of said wings, said bush (13) having, along an outer annular crown (13*b*) thereof, a groove (13*c*) for the housing of said peg (12) in the home position of said microswitch (11), wherein the movement of said bush (13) is constrained to that of the moving door by the keying-on engagement between a knurled portion (13*a*) of said bush (13), axially projecting from said appendix (11*a*) towards an opposite loop (2*a*) of said second wing (2), and grooves (14) obtained within said loop (2*a*) of said second wing (2).

2. Hinge as claimed in claim 1), wherein in any opening position of said door moving with respect to said fixed frame, said peg (12) rest on the outer surface of said annular crown (13*b*).

3. Hinge as claimed in claim 1), wherein said groove (13*c*) of said bush (13) is engaged at the desired angle with respect to the engagement area with said peg (12).

4. Hinge as claimed in claim 1), wherein with said bush (13) said small shaft (4) engages in rotation, axially fastened by dap joint means cooperating with an annular groove (6) arranged at one end of said small shaft (4).

5. Hinge as claimed in claim 1), wherein said switch body (7) is in the shape of a rectangular parallelepiped box which has on the top thereof and on the rear wall thereof collar-shaped guiding cut-outs (8, 9) for a power supply connector to go through.

6. Hinge as claimed in claim 1, wherein said switch body (7) is fastened on the upper edge of a wing (1), which it follows the contour of, so as to allow the 180° rotation of a wing (2) with respect to the other (1), until mutual contact between the two wings.

7. Hinge as claimed in claim 1), wherein said switch body (7) is made integrally with said wing (2).

8. Hinge as claimed in claim 1), wherein said switch body (7) is ultrasound-welded to said wing (2).

9. Hinge as claimed in claim 1), wherein said hinge is made of technopolymer.

* * * * *

UNITED STATES PATENT AND TRADEMARK OFFICE

CERTIFICATE OF CORRECTION

PATENT NO. : 8,966,714 B2
APPLICATION NO. : 14/173350
DATED : March 3, 2015
INVENTOR(S) : Alberto Bertani It is certified that error appears in the above-identified patent and that said Letters Patent is hereby corrected as shown below:

In the Specification

Column 2, line 24, "is" should read -- 1a --.

Signed and Sealed this
Twenty-first Day of July, 2015

Michelle K. Lee

Michelle K. Lee
*Director of the United States Patent and Trademark Office*